US010493472B2

(12) United States Patent
Kutnjak et al.

(10) Patent No.: US 10,493,472 B2
(45) Date of Patent: Dec. 3, 2019

(54) ROTARY ATOMIZER TURBINE

(71) Applicant: Dürr Systems AG, Bietigheim-Bissingen (DE)

(72) Inventors: Josip Kutnjak, Bietigheim-Bissingen (DE); Harry Krumma, Bönnigheim (DE); Timo Beyl, Besigheim (DE); Bernhard Seiz, Lauffen (DE)

(73) Assignee: DÜRR SYSTEMS AG, Bietigheim-Bissingen (DE)

( * ) Notice: Subject to any disclaimer, the term of this patent is extended or adjusted under 35 U.S.C. 154(b) by 57 days.

(21) Appl. No.: 15/544,658

(22) PCT Filed: Jan. 20, 2016

(86) PCT No.: PCT/EP2016/000101

§ 371 (c)(1),
(2) Date: Jul. 19, 2017

(87) PCT Pub. No.: WO2016/116275

PCT Pub. Date: Jul. 28, 2016

(65) Prior Publication Data

US 2017/0368561 A1 Dec. 28, 2017

(30) Foreign Application Priority Data

Jan. 20, 2015 (DE) ..... 10 2015 000 551

(51) Int. Cl.

| | |
|---|---|
| ***B05B 3/10*** | (2006.01) |
| ***B05B 3/00*** | (2006.01) |
| ***B05B 5/04*** | (2006.01) |

(52) U.S. Cl.

CPC ..... *B05B 3/1035* (2013.01); *B05B 3/003* (2013.01); *B05B 5/0415* (2013.01)

(58) Field of Classification Search

CPC ..... B05B 3/1035; B05B 3/003; B05B 3/082; B05B 5/0415; F01D 1/02; F01D 1/06; F01D 5/02; F01D 21/006; F03B 1/04; F03B 3/12

See application file for complete search history.

(56) References Cited

U.S. PATENT DOCUMENTS

| | | | | |
|---|---|---|---|---|
| 3,926,535 | A | 12/1975 | Morf | |
| 5,078,321 | A | 1/1992 | Davis et al. | |
| 5,668,711 | A | 9/1997 | Lavieville et al. | |
| 5,853,126 | A * | 12/1998 | Alexander | B05B 3/1064 239/223 |
| 7,322,793 | B2 * | 1/2008 | Baumann | B05B 3/1035 415/202 |

(Continued)

FOREIGN PATENT DOCUMENTS

| | | |
|---|---|---|
| CN | 87103117 A | 5/1988 |
| CN | 1057410 A | 1/1992 |

(Continued)

OTHER PUBLICATIONS

Doty F D et al: "High-Efficiency Microturbine Technology", Aerospace Power Systems. Boston, Aug. 4-9, 1991; Proceedings of the Intersociety Energy Conversion Engineering Conference, New York, IEEE US, vol. 2, Aug. 4, 1991. ISBN: 978-0-89448-163-5.

(Continued)

*Primary Examiner* — Grant Moubry
(74) *Attorney, Agent, or Firm* — Bejin Bieneman PLLC

(57) ABSTRACT

A rotary atomizer turbine is provided, the turbine including a turbine wheel with multiple turbine blades, a blade duct containing the turbine blades and being delimited radially by a duct wall, a braking air nozzle, a driving air nozzle and an outlet region at the outlet of the driving air nozzle. The outlet region is delimited at the outside by the duct wall of the blade duct and at the inside by the turbine blade respectively passing through it. The blade duct is delimited radially at the inside opposite the braking air nozzle by a stationary flow barrier. Furthermore, the outlet region of the individual driving air nozzles is a divergent cross-sectional region which widens in the flow direction and rotates with that turbine blade passing the driving air nozzle.

28 Claims, 5 Drawing Sheets

(56) References Cited

U.S. PATENT DOCUMENTS

Figure 1:
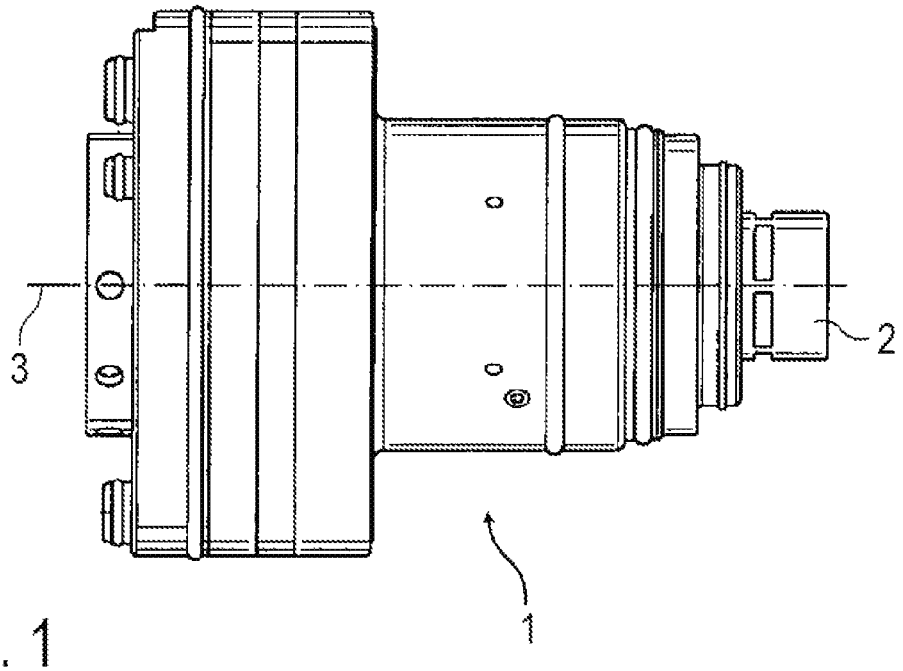

| | | | | |
|---|---|---|---|---|
| 7,721,976 | B2 * | 5/2010 | Nolte | B05B 3/1014 239/222.11 |
| 2004/0164190 | A1 | 8/2004 | Baumann et al. | |
| 2005/0258270 | A1 | 11/2005 | Nolte et al. | |
| 2007/0257131 | A1 | 11/2007 | Brett | |
| 2013/0017068 | A1 | 1/2013 | Baumann et al. | |
| 2014/0246524 | A1 * | 9/2014 | Kobayashi | F16C 32/0618 239/700 |
| 2015/0140235 | A1 * | 5/2015 | Meier | B05B 3/1014 427/600 |

FOREIGN PATENT DOCUMENTS

| | | | |
|---|---|---|---|
| CN | 2237491 | Y | 10/1996 |
| DE | 3508970 | C1 | 7/1986 |
| DE | 102 33 199 | A1 | 2/2004 |
| DE | 102 36 017 | B3 | 5/2004 |
| DE | 10 2010 013 551 | A1 | 10/2011 |
| EP | 1384516 | B1 | 11/2011 |
| EP | 2505778 | A1 | 10/2012 |
| FR | 2238382 | A5 | 2/1975 |
| GB | 2278554 | A | 12/1994 |
| JP | 2006300024 | A | 11/2006 |
| JP | 2013113179 | A | 6/2013 |
| JP | 2013245607 | A | 12/2013 |

OTHER PUBLICATIONS

International Search Report and Written Opinion for PCT/EP2016/000101 dated Mar. 29, 2016 (12 pages).

* cited by examiner

ROTARY ATOMIZER TURBINE

CROSS-REFERENCE TO RELATED APPLICATIONS

This application is a national stage of, and claims priority to, Patent Cooperation Treaty Application No. PCT/EP2016/000101, filed on Jan. 20, 2016, which application claims priority to German Application No. DE 10 2015 000 551.0, filed on Jan. 20, 2015, which applications are hereby incorporated herein by reference in their entireties.

BACKGROUND

A rotary atomizer turbine may be designed as a radial turbine for driving a spraying body (for example a bell plate) in a rotary atomizer.

In modern painting installations for the painting of motor vehicle body components, the application of paint is normally performed using rotary atomizers in which a bell plate, as a spraying body, rotates at a high rotational speed of up to 80,000 revolutions per minute.

The bell plate is normally driven by a pneumatically driven turbine, which is normally in the form of a radial turbine, which supplies the driving air for driving the turbine in a plane oriented radially with respect to the axis of rotation of the turbine. A rotary atomizer turbine of said type is known for example from EP 1 384 516 B1 and DE 102 36 017 B3.

Typically, multiple turbine blades are arranged on a rotatable turbine wheel so as to be distributed over the circumference, which turbine blades are subjected to a flow of driving air by driving air nozzles in order to mechanically drive the rotary atomizer turbine.

Furthermore, the known rotary atomizer turbines also permit rapid braking of the rotary atomizer turbine, for example in the event of an interruption in painting operation. For this purpose, the turbine blades are subjected to a flow of braking air counter to the direction of rotation by a separate braking nozzle. However, said known rotary atomizer turbines are not optimal in various respects.

Firstly, the braking performance is not optimal, such that during a braking process, the rotary atomizer turbine comes to a standstill only after a certain run-down time.

Secondly, there is also the aim of increasing the drive power of the rotary atomizer turbine in order that the surface coating performance can be correspondingly increased. Specifically, to increase the surface coating performance, an increased paint flow (amount of paint per unit of time) must be applied, which in turn leads to a greater mechanical load on the rotary atomizer turbine and requires correspondingly increased drive power.

The technological background of the present disclosure also includes DE 102 33 199 A1, DE 10 2010 013 551 A1 and US 2007/0257131 A1. However, these publications do no solve the problem of an unsatisfactory braking power and drive power.

SUMMARY OF THE DISCLOSURE

The present disclosure is thus based on the object of providing a correspondingly improved rotary atomizer turbine.

Said object is achieved by means of a rotary atomizer turbine according to the present disclosure.

The present disclosure is based on newly obtained findings in the field of fluid dynamics with regard to the disadvantages of the known rotary atomizer turbines as mentioned in the introduction.

Accordingly, the unsatisfactory braking performance in the case of the known rotary atomizer turbines can, in part, be attributed to the fact that the braking air supplied via the braking air nozzle flows partially in a radial direction through the annularly encircling blade arrangement, and then no longer contributes to the braking action. That is to say, a portion of the braking air impinges on the front side of the turbine blades counter to the direction of rotation of the turbine blade, and thus exerts a braking action on the turbine wheel, which is desirable. By contrast, another portion of the braking air flows through the annularly encircling blade arrangement from the outside to the inside, and thus does not contribute to the braking action, or even additionally exerts a driving action on the turbine wheel.

One aspect of the present disclosure therefore makes provision for the braking air to be prevented from being able to flow from the outside to the inside through the annularly encircling blade arrangement. For this purpose, a flow barrier is provided which may be arranged in a stationary position opposite the braking air nozzle, wherein the flow barrier prevents the braking air that emerges from the braking air nozzle from being able to flow from the outside to the inside in the radial direction through the annularly encircling blade arrangement. The flow barrier thus prevents the braking air in the region of the braking air nozzle from emerging again from the blade duct, in which the individual turbine blades run, in the inward direction.

The flow barrier may for example be a simple annularly encircling plate which is arranged at the inside on the blade duct, opposite the braking air nozzle.

The flow barrier is, in some implementations, stationary, that is to say the flow barrier does not rotate together with the turbine wheel.

It may for example be provided that the flow barrier in the region of the braking air nozzle extends in the circumferential direction over an angle of 5°-90°, specifically, for example, an angle of 30°-40° (and more specifically, for example, approximately 33').

In this context, it must be mentioned that the turbine wheel may be open in a radial direction over a part of its circumference, such that the driving air from the driving air nozzles can flow in the radial direction from the outside to the inside through the annularly encircling blade arrangement in the open part of the turbine wheel, as is also the case in the conventional rotary atomizer types described in the introduction. It is therefore expedient for the flow barrier to extend in the circumferential direction only over the region of the braking air nozzle, in order that the flow barrier impedes the driving air to the least possible extent.

The open form of the turbine wheel mentioned above may for example be realized by virtue of the turbine wheel having a disc, from one side of which the turbine blades project in an axial direction into the blade duct. It is thus possible for the driving air to flow from the outside to the inside through the annularly encircling blade arrangement of the turbine blades.

It is however alternatively also possible for the turbine wheel to have two parallel rotating discs, axially between which the individual turbine blades are arranged. The turbine wheel can thus also be closed on both sides.

Furthermore, the present disclosure is based on findings in the field of fluid dynamics that the unsatisfactory drive power of the known rotary atomizer turbines arises, in part, from the fact that a convergent-divergent flow duct is formed downstream of each of the individual driving air nozzles at the outlet of the driving air nozzles, giving rise to an intense, high-loss compression shock owing to the fact that the flow passes into the subsonic state there. Said convergent-divergent flow duct is typically formed at the outside by the duct wall of the blade duct and at the inside by the encircling front side of the respective turbine blade. Owing to the intense curvature of typical individual turbine blades, the driving air flow thus passes initially through a convergent region, in which the flow cross section between the arched front side of the turbine blade and the duct wall of the blade duct narrows. The driving air flow then subsequently passes through a divergent region in which the flow cross section between the intensely arched front side of the respective turbine blade and the duct inner wall widens. A convergent-divergent flow profile of said type corresponding to a de Laval nozzle is however undesirable owing to the above-mentioned disruptive compression shocks.

The present disclosure therefore provides that an outlet region of the individual driving air nozzles between the duct wall of the blade duct and the respective turbine blade runs in an exclusively divergent manner, such that the cross-sectional region widens in the flow direction and rotates with that turbine blade which is presently passing the outlet region of the driving air nozzles. This aspect of the present disclosure thus targetedly prevents a convergent-divergent flow duct from forming in a supersonic flow at the outlet of the individual driving air nozzles downstream of the respective driving air nozzle. In the case of the rotary atomizer turbine according to the present disclosure, therefore, it is thus advantageously the case that no convergent cross-sectional region is provided downstream of the driving air nozzle.

The divergent cross-sectional area, in some implementations, forms an output-side part of a Laval nozzle, which rotates with the turbine wheel. The upstream portion of the Laval nozzle is then, in some implementations, formed by the driving air nozzle which then narrows in the direction of flow (converges). The Laval nozzle then consists of a revolving nozzle part (i.e. the divergent cross-sectional area) and a stationary nozzle part (i.e. the driving air nozzle).

Figure 6:
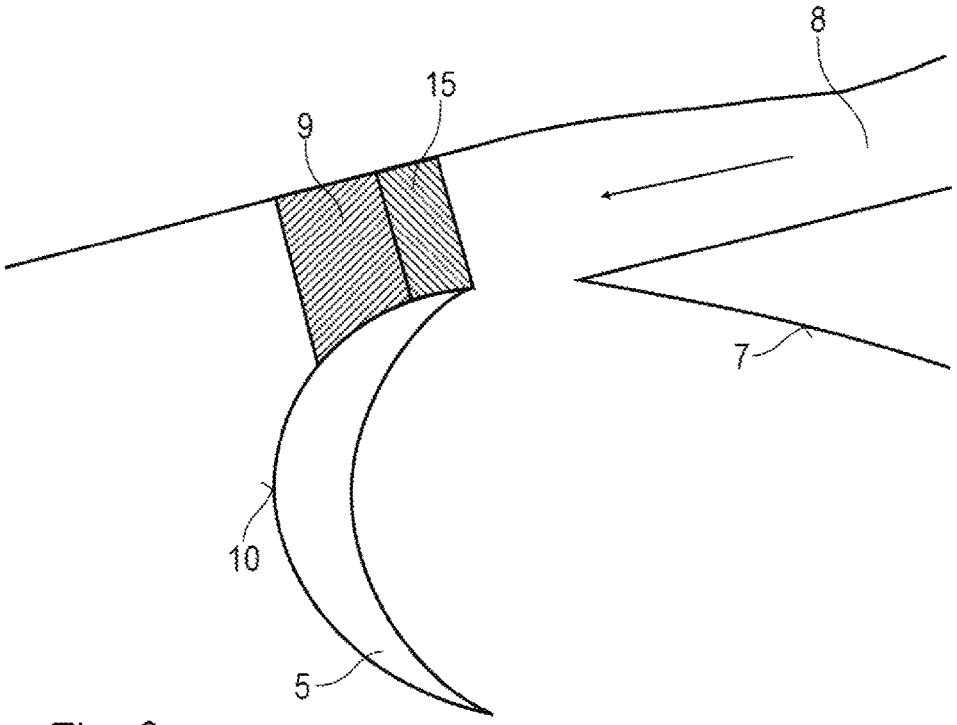
Fig. 6 Prior Art

In the divergent cross-sectional area, the flow be accelerated and the pulse is increased again, whereas—as in the prior art shown in FIG. 6—(i.e. narrowing in the flow direction) a convergent cross-sectional area would produce a disturbing shock wave.

The Laval nozzle generates in some implementations a supersonic flow, at least in the downstream, divergent nozzle portion, but optionally also in the upstream convergent nozzle portion. This is a fundamental difference to a subsonic flow, such as in a diffuser, as in US 2007/0257131 A1. According to some implementations of the present disclosure, a super-sonic flow enters the divergent cross-sectional area where the flow velocity is further increased.

This is achieved by means of a suitable curvature of the individual turbine blades and by means of a corresponding design of the blade duct in the outlet region of the individual driving air nozzles.

In an exemplary embodiment of the present disclosure, the divergent cross-sectional region of the outlet region of the individual driving air nozzles widens in the flow direction with an angle of at least 2°, 4°, or even at least 6°.

The divergent cross-sectional region may extend in the circumferential direction over an angle of more than 5°, 10°, 15°, 20°, or even 30°.

It has already been mentioned above that the exclusively divergent cross-sectional region may be realized, inter alia, by means of a suitable design of the duct wall of the blade duct. In the exemplary embodiment of the present disclosure, the duct wall of the blade duct therefore has, in the outlet region of the driving air nozzle, an outwardly arched recess for forming the divergent cross section. The expression "arched recess" is in this case to be understood in relation to an ideal circular circumference of the duct wall, wherein the arched recess deviates outwardly from the ideal circular circumference of the duct wall in order to form the divergent cross section.

In the exemplary embodiment, said arched recess in the duct wall of the blade duct is concave and extends in the circumferential direction over an angle of 10°-90°, for example, an angle of 40°-50°. It is important here that the arched recess, on the one hand, and the arched front side of the individual turbine blades, on the other hand, together form a divergent cross section which rotates with the rotation of the turbine wheel.

It has already been briefly mentioned above that the individual turbine blades are each curved in a radial direction, such that the outer end of the turbine blades is directed counter to the direction of rotation of the turbine wheel. The individual turbine blades may then, in each case with their front side at the outer end of the turbine blades, enclose a particular angle with the outer circular circumference of the blade duct, wherein said angle may be at least 2°, 5°, or even at least 10°.

The turbine according to some implementations of the present disclosure is adapted to be driven by pressurized air with an air pressure of 6 bar which is the standard air pressure in painting installations. It should be noted that the improved efficiency of the atomizer according to the present disclosure allows more operations (i.e. different values of rotary speed, paint flow rate, etc.) with the standard air pressure of 6 bar without the need for an increased air pressure. However, the turbine can alternatively be adapted to be driven by pressurized air with an air pressure of 8 bar.

In any case, the present disclosure allows a higher driving power compared with conventional atomizer turbines. This in turn allows higher flow rates of the paint. For example, the rotary speed of the atomizer can be higher than 10,000 rpm, 20,000 rpm, 50,000 rpm or even higher than 60,000 rpm. Further, the flow rate of the paint applied by the atomizer can be higher than 200 ml/min., 300 ml/min., 400 ml/min., 500 ml/min. or even higher than 600 ml/min.

It must also be mentioned that the present disclosure does not only include the above-described rotary atomizer turbine according to the present disclosure as an individual component. Rather, the present disclosure also includes a complete rotary atomizer with a rotary atomizer turbine of said type.

DRAWINGS

Figure 2:
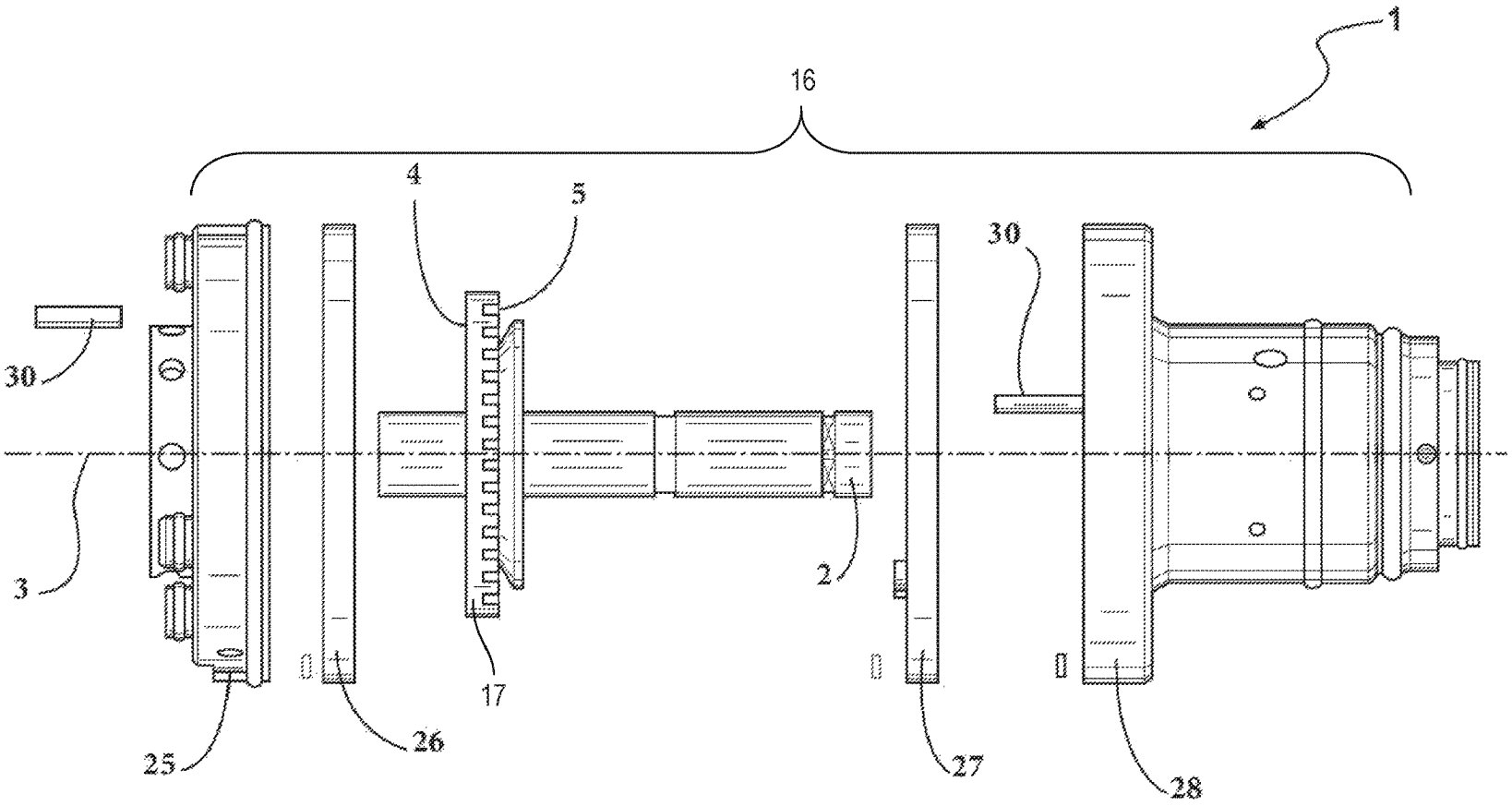
Figure 3A:
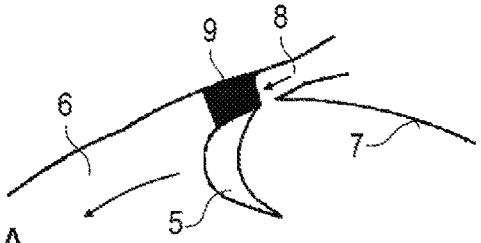
Figure 3B:
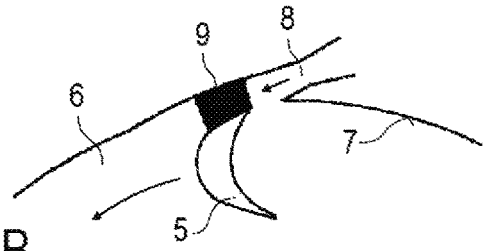
Figure 3C:
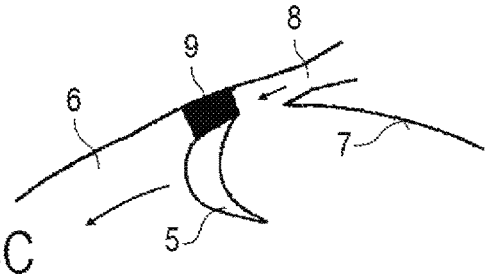
Figure 3D:
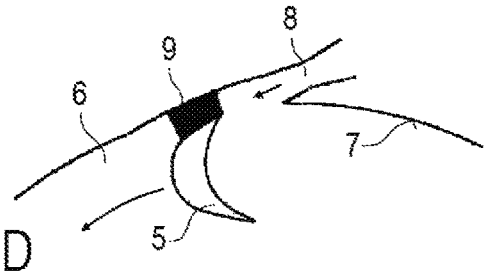
Figure 3E:
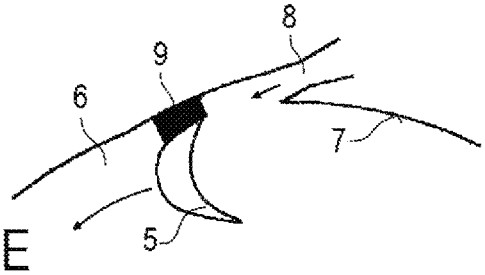
Figure 3F:
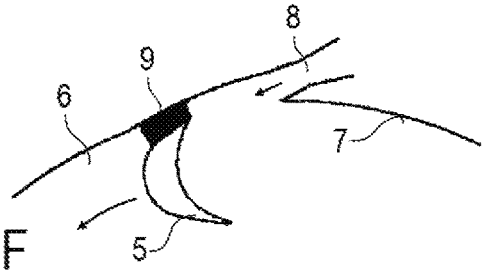
Figure 4:
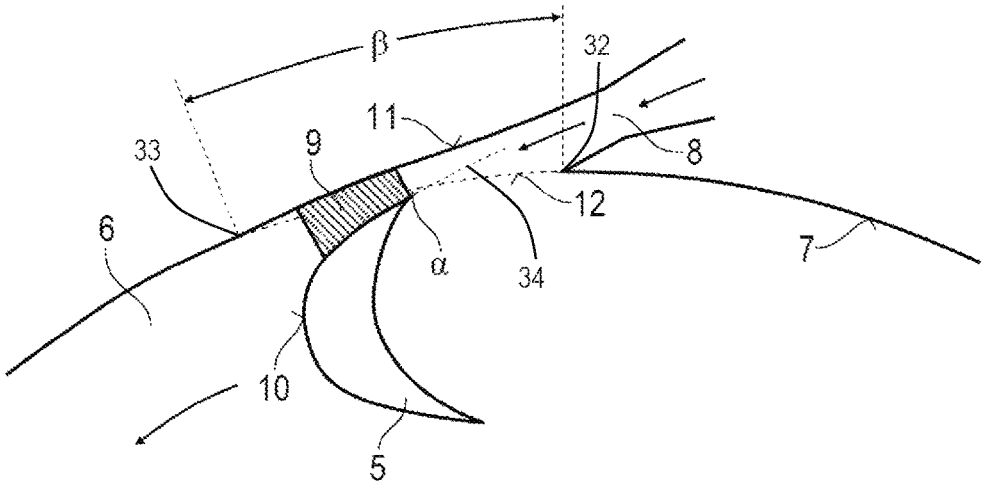
Figure 5:
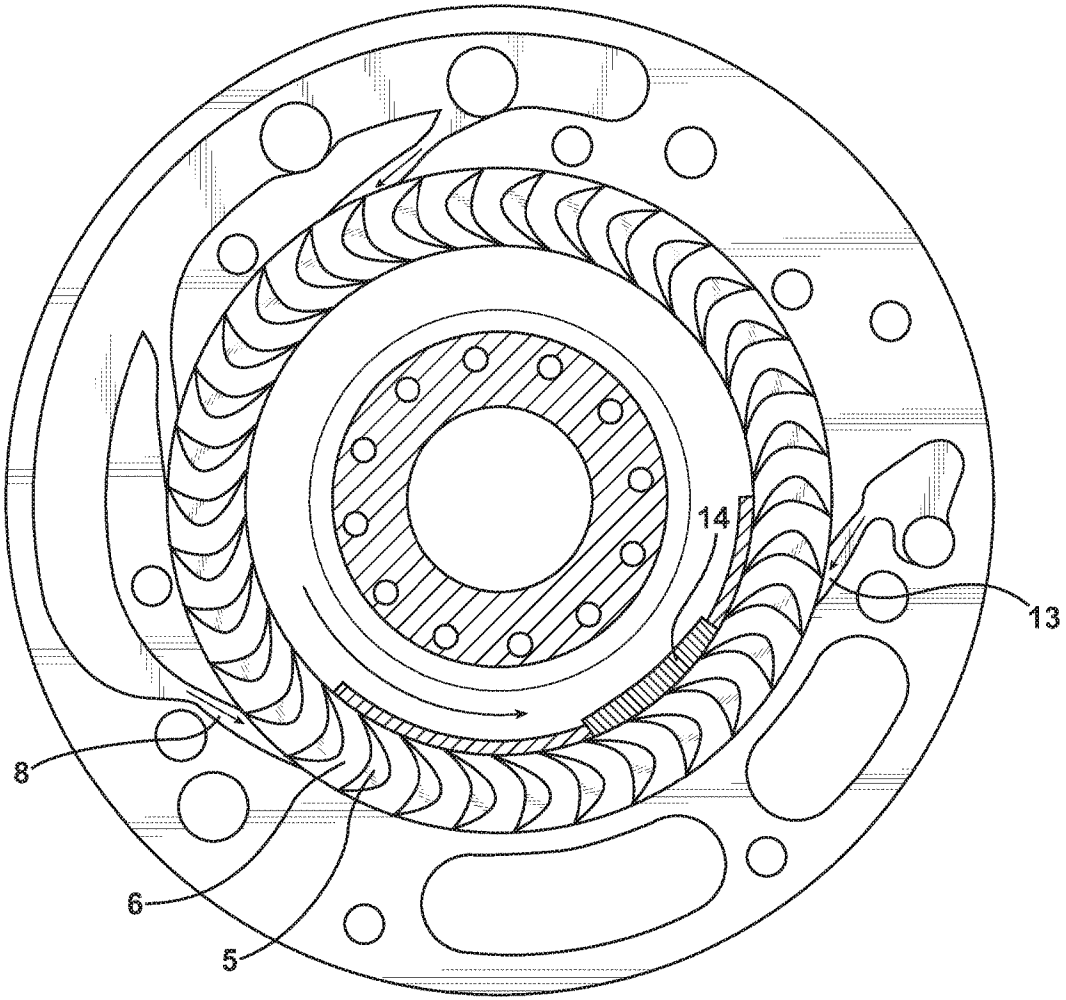

Other advantageous refinements of the present disclosure are explained in more detail below together with the description of the exemplary implementations of the present disclosure on the basis of the figures, in which:

FIG. 1 shows a side view of a rotary atomizer turbine,

FIG. 2 shows an exploded side view of the rotary atomizer turbine from FIG. 1, FIGS. 3A-3F are schematic illustrations of the divergent cross-sectional region at the outlet of the driving air nozzles for different, successive angular positions of the turbine wheel, FIG. 4 is a detail illustration of the divergent cross-sectional region, FIG. 5 shows a cross-sectional view illustrating a flow barrier opposite the braking air nozzle, FIG. 6 is a schematic illustration of the disruptive convergent-divergent cross-sectional region in the case of the prior art.

DETAILED DESCRIPTION

Referring to FIGS. 1-2, a rotary atomizer turbine 1 for driving a bell plate according to the present disclosure is shown, which rotary atomizer turbine 1 may be screwed onto a bell plate shaft 2, wherein the bell plate shaft 2 rotates about an axis of rotation 3 during operation.

The bell plate shaft 2 bears a turbine wheel 4, i.e., the turbine wheel 4 is mounted to the bell plate shaft 2. Numerous turbine blades 5 are attached to the turbine wheel 4 so as to be distributed over the circumference and project axially from the turbine wheel 4, e.g., the turbine blades 5 are formed on a side of the turbine wheel 4. The turbine wheel 4 presents a circular disk 17 extending to a peripheral rim. The turbine blades 5 extend radially relative to the axis 3 and are spaced annularly about the circular disk 17. The individual turbine blades 5 project in this case into a blade duct 6 (shown in FIGS. 3A-5), which is delimited radially at the outside by an annularly encircling duct wall 7.

The housing 16 of the rotational atomizer turbine 1 has several housing parts, as shown in FIGS. 1 and 2. The rotary atomizer turbine 1 includes a first end component 25, a nozzle ring 26, a distance ring 27 and a second end component 28. The first and second end components 25, 28, the nozzle ring 26 and the distance ring 27 are axially and radially coupled to one another, e.g., with fastening pins 30, about the bell plate shaft 2 to for a housing assembly for the rotary atomizer turbine 1, such that the bell plate shaft 2 may rotate about the axis 3 when encased in the housing (FIG. 1). The nozzle ring 26 surrounds the turbine wheel 4, as shown in FIG. 5, so that the interior of the nozzle ring 26 forms a cylindrical turbine chamber 25, in which the turbine wheel 4 is rotated.

Multiple driving air nozzles 8 issue into the blade duct 6 from the outside, as can be seen from FIGS. 3A-3F and 4. The air nozzles 8 are defined in the nozzle ring 26. It should be understood that the nozzle ring 26 may define any suitable number of air nozzles 8. The individual driving air nozzles 8 each discharge a driving air flow substantially tangentially, in the direction of the arrow shown in FIGS. 3A-5, into the blade duct 6 in order to rotate the turbine wheel 4. In this case, at the outlet region of the driving air nozzles 8, the driving air flows initially through a divergent cross-sectional region 9.

The divergent cross-sectional region 9 is formed at the inside by an arched front side 10 of the turbine blade 5 that is presently passing through and at the outside by an arched recess 11 in the duct wall 7. The divergent cross-sectional region 9 thus rotates in the direction of rotation with that turbine blade 5 which is respectively presently passing the outlet region of the respective driving air nozzle 8.

By contrast to the known rotary atomizers described in the introduction, however, no convergent-divergent cross-sectional region similar to a de Laval nozzle is formed at the outlet of the individual driving air nozzles 8, because this would lead to high-loss compression shocks. The absence of such a disruptive convergent-divergent cross-sectional region thus advantageously leads to an increase in drive power of the rotary atomizer turbine 1 according to the present disclosure.

Referring again to FIG. 2, of the pair of pins 30 may extend through openings defined in the first and second end components 25, 28, the nozzle ring 26 and the distance ring 27 to lock these parts together in assembled mode and prevent side movement of the first and second end components 25, 28, the nozzle ring 26 and the distance ring 27 relative to one another.

The annular intermediate chamber 12 is covered by the distance ring 27, to cover the opening in the mounted state.

The fixed nozzle itself is a Laval nozzle. This is characterized by a convergent channel which accelerates the flow to sonic speed up to the narrowest cross section. From the narrowest cross-section, the channel is divergent, whereby an acceleration to supersonic speed is carried out. The divergent channel between the housing and the blade is a supersonic nozzle when the flow enters at supersonic speed. This divergent channel between the housing and the rotating blade can also be viewed as an extension of the Laval nozzle.

Downstream of the individual driving air nozzles 8, the arched recess 11 extends in the circumferential direction in each case over an angle $\beta$ in the range of 15°-30°. Specifically, as shown in FIG. 4, the driving air nozzles 8 include an edge 32 and an end 33 spaced along the circumference of the duct wall 7, i.e., along an arc of the duct wall 7. The path of the circumference of the duct wall 7 across the air nozzle 8 from the edge 32 to the end 33, i.e., an ideal circumference of the duct wall 7, is identified with reference numeral 12 in FIG. 4. The angle $\beta$ extends along the path 12 from the edge 32 to the end 33. The angle $\beta$ shown in FIG. 4 is shown for example, and it should be appreciated that the angle $\beta$ may be between 15°-30°, as set forth above.

With continued reference to FIG. 4, the front side 10 of the individual turbine blades 5 encloses in each case, at its outer, free end 33, an angle $\alpha$=15°-30° with the path 12 of the circumference of the duct wall 7. Specifically, the tangent 34 of the front side 10 of the turbine blade 5 at the free end 33 is shown in FIG. 4. The angle $\alpha$ is defined between the tangent 34 of the front side 10 and the path 12 of the circumference of the duct wall 7, as shown in FIG. 4.

Referring to FIG. 5, a braking air nozzle 13 opens out into the blade duct 6 in order to subject the turbine blades 5 to a flow of working air, wherein the braking air flow is directed counter to the direction of rotation of the turbine wheel 4.

In this case, at the inner side of the blade duct 6, there is situated a flow barrier 14 which prevents the braking air from the braking air nozzle 13 from simply flowing in a radial direction through the annularly encircling blade arrangement and then emerging from the blade duct 6 again at the inside. Referring in particular FIG. 2, the flow barrier 14 is fixed to the distance ring 27, and extends axially toward the turbine wheel 4. When assembled, as shown, e.g., in FIG. 1, the flow barrier 14 is radially inward of the turbine blades 5 and the blade duct 6. In this way, the braking air that emerges from the braking air nozzle 13 is retained within the blade duct 6 and thus contributes in a significantly more efficient manner to the braking of the turbine wheel 4.

The flow barrier 14 may extend in the circumferential direction over an angle of 20°-40°, wherein, in one example, an angle of 33° is preferred.

Finally, FIG. 6 shows, for comparison, the outlet region of the driving air nozzle 8 in the case of a conventional rotary atomizer turbine. It can be seen from the drawing that, upstream of the divergent cross-sectional region 9, there is initially a convergent cross-sectional region 15. The convergent cross-sectional region 15 thus forms, together with the subsequent divergent cross-sectional region 9, a nozzle similar to a de Laval nozzle, which leads to undesired compression shocks, whereby the drive power of the rotary atomizer turbine is reduced.

It should be understood that the present disclosure is not restricted to the exemplary description herein. Rather, numerous variants and modifications are possible according to the principles of the present disclosure.

The invention claimed is:

1. A radial turbine for driving a spraying body in a rotary atomizer, the turbine comprising:

a turbine wheel rotatably coupled about an axis, the turbine wheel having a plurality of turbine blades extending axially from the turbine wheel, the plurality of turbine blades being annularly arranged on the turbine wheel at a perimeter of the turbine wheel, the arrangement of the plurality of turbine blades defining a driving direction of the turbine wheel about the axis and a braking direction of the turbine wheel counter to the driving direction about the axis;

a duct wall radially encircling the turbine wheel and axially extending over the turbine blades and defining a blade duct over the turbine wheel, the blade duct being coaxially arranged with the turbine wheel;

at least one driving air nozzle opening into the blade duct and axially overlapping the turbine blades, the at least one driving air nozzle configured to direct a flow of driving air along the driving direction, the at least one driving air nozzle defining an outlet region between a circumference of the blade duct and a portion of the duct wall open to the at least one driving air nozzle;

at least one braking air nozzle opening into the blade duct and axially overlapping the turbine blades, the at least one braking air nozzle being configured to direct a flow of braking air to the plurality of turbine blades along the braking direction; and a flow barrier fixed relative to the duct wall within the blade duct, the flow barrier being radially inside of the turbine blades and axially overlapped with the turbine blades, the flow barrier opposing the outlet region of the at least one braking air nozzle, the flow barrier configured to retain braking air within the blade duct.

2. The radial turbine according to claim 1, wherein the flow barrier extends over a circumferential angle of greater than 5° and less than 90°.

3. The radial turbine according to claim 1, wherein the turbine wheel defines an open region radially inside of the turbine blades.

4. The radial turbine according to claim 1, wherein, upon rotation of the turbine blades respectively along the outlet region of the at least one driving air nozzle, each of the turbine blades respectively defines a divergent cross-sectional region between the portion of the duct wall open to the at least one driving air nozzle and a front surface of the respective turbine blade, the divergent cross-sectional regions each maintaining a shape that widens along the flow of driving air while passing the at least one driving air nozzle.

5. The radial turbine according to claim 4, wherein each of the divergent cross-sectional regions angularly widens at least 2° along the flow of driving air.

6. The radial turbine according to claim 1, wherein, in the outlet region of the at least one driving air nozzle, the portion of the duct wall open to the at least one driving air nozzle includes a recess arched radially outwardly and configured to form the divergent cross sections with the turbine blades, respectively.

7. The radial turbine according to claim 6, wherein the recess circumferentially extends over an angle of at least 10° and at most 90°.

8. The radial turbine according to claim 1, wherein each of the turbine blades is curved such that a front side thereof is directed counter to the driving direction of the turbine wheel.

9. The radial turbine according to claim 8, wherein the front side at an outer free end is an angle between 15 degrees and 30 degrees.

10. The radial turbine according to claim 1, wherein the driving air nozzle is a de Laval nozzle.

11. A radial turbine for driving a spraying body in a rotary atomizer, comprising:

a turbine wheel having multiple turbine blades annularly distributed over the circumference, the turbine wheel configured to rotate about an axis in a driving direction;

a duct wall coaxially encircling the turbine blades to define a blade duct therewithin;

at least one braking air nozzle opening into the blade duct, the at least one braking air nozzle configured to direct a flow of braking air counter to the driving direction of the turbine wheel; and at least one driving air nozzle opening into the blade duct, the at least one driving air nozzle configured to direct a flow of driving air along the driving direction of the turbine wheel, the at least one driving air nozzle defining an outlet region between a portion of the duct wall open to the at least one driving air nozzle and a circumference of the blade duct, wherein, upon rotation of the turbine wheel in the driving direction, and while each of the turbine blades respectively passes the at least one driving air nozzle, each of the turbine blades defines a divergent cross-sectional region between the portion of the duct wall open to the at least one driving air nozzle and a front surface of the respective turbine blade, the divergent cross-sectional regions each maintaining a shape that widens along the flow of driving air and a flow barrier fixed relative to the duct wall within the blade duct, the flow barrier being radially inside of the turbine blades and axially overlapped with the turbine blades, the flow barrier opposing the outlet region of the at least one braking air nozzle, the flow barrier configured to retain braking air within the blade duct.

12. The radial turbine according to claim 11, wherein the flow barrier extends over a circumferential angle of greater than 5° and less than 90°.

13. The radial turbine according to claim 11, wherein the turbine wheel defines an open region radially inside of the turbine blades.

14. The radial turbine according to claim 11, wherein each of the divergent cross-sectional regions angularly widens at least 2° along the flow of driving air.

15. The radial turbine according to claim 11, wherein, in the outlet region of the at least one driving air nozzle, the portion of the duct wall open to the at least one driving air nozzle includes a recess arched radially outwardly and configured to form the divergent cross sections with the turbine blades, respectively.

16. The radial turbine according to claim 11, wherein each of the turbine blades is curved such that the outer end thereof is directed counter to the driving direction of the turbine wheel.

17. The radial turbine according to claim 16, wherein a front surface at the outer end of each of the turbine blades extends radially inwardly at an angle of at least 2° from the circumference of the blade duct.

18. The radial turbine according to claim 11, wherein the driving air nozzle is a de Laval nozzle.

19. A radial turbine for driving a spraying body in a rotary atomizer, comprising:

a turbine wheel having multiple turbine blades annularly distributed over the circumference, the turbine wheel configured to rotate about an axis in a driving direction;

a duct wall coaxially encircling the turbine blades to define a blade duct therewithin;

at least one braking air nozzle opening into the blade duct, the at least one braking air nozzle configured to direct a flow of braking air counter to the driving direction of the turbine wheel; and at least one driving air nozzle opening into the blade duct, the at least one driving air nozzle configured to direct a flow of driving air along the driving direction of the turbine wheel, the at least one driving air nozzle defining an outlet region between a portion of the duct wall open to the at least one driving air nozzle and a circumference of the blade duct, wherein, upon rotation of the turbine wheel in the driving direction, and while each of the turbine blades respectively passes the at least one driving air nozzle, each of the turbine blades defines a divergent cross-sectional region between the portion of the duct wall open to the at least one driving air nozzle and a front surface of the respective turbine blade, the divergent cross-sectional regions each maintaining a shape that widens along the flow of driving air wherein, in the outlet region of the at least one driving air nozzle, the portion of the duct wall open to the at least one driving air nozzle includes a recess arched radially outwardly and configured to form the divergent cross sections with the turbine blades, respectively.

20. The radial turbine according to claim 19, wherein the recess circumferentially extends over an angle of at least 10° and at most 90°.

21. The radial turbine according to claim 19 further comprising a flow barrier fixed relative to the duct wall within the blade duct, the flow barrier being radially inside of the turbine blades and axially overlapped with the turbine blades, the flow barrier opposing the outlet region of the at least one braking air nozzle, the flow barrier configured to retain braking air within the blade duct.

22. The radial turbine according to claim 21, wherein the flow barrier extends over a circumferential angle of greater than 5° and less than 90°.

23. The radial turbine according to claim 19, wherein the turbine wheel defines an open region radially inside of the turbine blades.

24. The radial turbine according to claim 19, wherein each of the divergent cross-sectional regions angularly widens at least 2° along the flow of driving air.

25. The radial turbine according to claim 19, wherein the recess circumferentially extends over an angle of at least 10° and at most 90°.

26. The radial turbine according to claim 19, wherein each of the turbine blades is curved such that the outer end thereof is directed counter to the driving direction of the turbine wheel.

27. The radial turbine according to claim 26, wherein a front surface at the outer end of each of the turbine blades extends radially inwardly at an angle of at least 2° from the circumference of the blade duct.

28. The radial turbine according to claim 19, wherein the driving air nozzle is a de Laval nozzle.

* * * * *